US010641478B2

(12) United States Patent
Sun et al.

(10) Patent No.: US 10,641,478 B2
(45) Date of Patent: May 5, 2020

(54) MULTIFUNCTIONAL LIGHT AND SET THEREOF

(71) Applicant: Zhejiang Yotrio Group Co., Ltd., Linhai (CN)

(72) Inventors: Linyong Sun, Linhai (CN); Jianqiang Xie, Linhai (CN)

(73) Assignee: Zhejiang Yotrio Group Co., Ltd., Linhai (CN)

( * ) Notice: Subject to any disclaimer, the term of this patent is extended or adjusted under 35 U.S.C. 154(b) by 0 days.

(21) Appl. No.: 16/448,688

(22) Filed: Jun. 21, 2019

(65) Prior Publication Data

US 2019/0390851 A1 Dec. 26, 2019

(30) Foreign Application Priority Data

Jun. 21, 2018 (CN) ..... 2018 2 0962796 U

(51) Int. Cl.
*F21V 31/00* (2006.01)
*F21L 4/08* (2006.01)
(Continued)

(52) U.S. Cl.
CPC ..... *F21V 31/005* (2013.01); *F21L 4/04* (2013.01); *F21L 4/08* (2013.01); *F21V 21/0885* (2013.01);
(Continued)

(58) Field of Classification Search
CPC ..... F21V 21/0885; F21V 21/096; F21V 21/0965; F21V 23/0421; F21V 23/023; F21V 31/005; F21L 4/08; F21L 4/085
(Continued)

(56) References Cited

U.S. PATENT DOCUMENTS 5,528,472 A * 6/1996 Maglica ..... F21L 4/005 200/60
2008/0130268 A1* 6/2008 Johnson ..... F21L 4/00 362/103
2011/0199757 A1* 8/2011 Cheng ..... B60N 3/14 362/183
2012/0182748 A1* 7/2012 McCaslin ..... A42B 3/044 362/473
(Continued)

FOREIGN PATENT DOCUMENTS

JP 2003142841 A * 5/2003

OTHER PUBLICATIONS

Machine translation of Nakamae et al., JP 2003142841A, published May 16, 2003 (Year: 2003).*

*Primary Examiner* — William N Harris
(74) *Attorney, Agent, or Firm* — Schwegman Lundberg & Woessner, P.A.

(57) ABSTRACT

This invention provides a multifunctional light and a multifunctional light set, wherein the multifunctional light includes a light base, a light body, a power supply and a sealing member. The light base has a power supply installation port, and the light body is disposed at the light base. The power supply is detachably installed in the light body through the power supply installation port and supplies power to the light body, and the sealing member seals the power supply installation port, which makes it easy for a user to replace the power supply. In addition, the multifunctional light further includes a built-in cover and a sealing ring, the sealing ring fits in inner sides of the built-in cover in an interference fit way, and the built-in cover is engaged into and seals the power supply installation port to ensure that sealing and waterproof properties of the multifunctional light are good.

9 Claims, 7 Drawing Sheets

(51) Int. Cl.

| | |
|---|---|
| ***F21V 21/088*** | (2006.01) |
| ***F21V 23/06*** | (2006.01) |
| ***F21V 23/04*** | (2006.01) |
| ***F21L 4/04*** | (2006.01) |
| ***F21V 23/02*** | (2006.01) |
| ***F21V 21/096*** | (2006.01) |
| ***F21V 33/00*** | (2006.01) |
| *F21W 131/10* | (2006.01) |

(52) U.S. Cl.
CPC ..... *F21V 21/096* (2013.01); *F21V 23/023* (2013.01); *F21V 23/0421* (2013.01); *F21V 23/06* (2013.01); *F21V 33/006* (2013.01); *F21V 23/0435* (2013.01); *F21W 2131/10* (2013.01)

(58) Field of Classification Search
USPC ..... 362/183
See application file for complete search history.

(56) References Cited

U.S. PATENT DOCUMENTS

2013/0329412 A1* 12/2013 Ko ..... F21L 4/045 362/191
2014/0036520 A1* 2/2014 Chen ..... F21V 21/0965 362/428
2014/0098524 A1* 4/2014 Liao ..... F21V 21/0885 362/183
2014/0321904 A1* 10/2014 Bao ..... F16M 13/00 403/132
2015/0192243 A1* 7/2015 Sharrah ..... F16M 11/28 362/190
2015/0267902 A1* 9/2015 Zhang ..... F21L 4/04 362/188
2016/0153626 A1* 6/2016 Ozaka ..... H02J 7/0031 362/86
2017/0205058 A1* 7/2017 Ostrander ..... F21V 21/0885
2018/0224114 A1* 8/2018 Bian ..... F21V 33/0056
2018/0327154 A1* 11/2018 Solan ..... B65D 51/248
2019/0011089 A1* 1/2019 Whiting ..... F02N 11/12
2019/0017689 A1* 1/2019 Parsons ..... F21V 23/0421

* cited by examiner

MULTIFUNCTIONAL LIGHT AND SET THEREOF

CROSS-REFERENCE TO RELATED APPLICATIONS

This Non-provisional application claims priority under 35 U.S.C. § 119(a) on Chinese Patent Application No(s). 201820962796.2 filed on Jun. 21, 2018, the entire contents of which are hereby incorporated by reference.

BACKGROUND OF THE INVENTION

Field of the Invention

This invention relates to a lighting field, and more particularly, to a multifunctional light and a set thereof wildly applied to a sunshade, a tent, furniture, a swing and other occasions.

Description of the Related Art

With continuous development of society, lighting sunshades with both shading and lighting functions, intelligent lighting tents, lighting swings and furniture have been widely used in homes, swimming pools, hotels and other entertainment and leisure places. A light-type leisure product can not only bring a lot of convenience to people's lives, but also provide good lighting effects and atmosphere.

As a light-type leisure product for outdoor use, its sealing and waterproof properties are required to be relatively high. If it is easy to enter water, it can easily cause damage to internal circuits and batteries. Although most of the light-type leisure products have the good lighting effect at present, their sealing and waterproof properties are not satisfactory.

Due to limited outdoor conditions, it is often inconvenient to power the outdoor light-type leisure product. However, the existing outdoor light-type products have a single power connection method and are not flexible enough, which limit and influence the user's experience. Some outdoor light-type users often need to connect an indoor circuit to power and light, which causes great inconvenience.

In addition, most of the light-type leisure products for outdoor use are complex in structure, heavy in overall weight, inconvenient to use, complicated to install and disassemble, and extremely inconvenient to maintain. For example, one of the lamps is installed at a rib of a lighting sunshade through screws so as to provide the lighting effect. People often need tools to install this lamp at the rib through the screw or disassemble it from the rib, which is relatively troublesome. For another example, another kind of lamp needs to be bound at the rib through a rope or the like. The rope used for binding often affects the lighting effect of the lamp, it is easy to move when people bind the lamp, and the fixation is not secure.

BRIEF SUMMARY OF THE INVENTION

To solve the above-mentioned problems, this invention provides a multifunctional light including a light base, a light body, a power supply and a sealing member. The light base has a power supply installation port, the light body is disposed at the light base, and the power supply is detachably installed in the light body through the power supply installation port and supplies power to the light body. The sealing member seals the power supply installation port.

According to one embodiment of this invention, the sealing member may be engaged into the power supply installation port in an interference fit way.

According to one embodiment of this invention, perimeters of the sealing member may be fixed at edges of the power supply installation port in a sealing way through a fastener member.

According to one embodiment of this invention, the sealing member may include a power supply cover and a built-in cover, the built-in cover may snap into and seal the power supply installation port, and the power supply cover may snap into the light base and cover the built-in cover.

According to one embodiment of this invention, the sealing member may further include a sealing ring, and the sealing ring may fit in inner sides of the built-in cover in an interference fit way.

According to one embodiment of this invention, surfaces of the built-in cover may be coated with a sealing film, and the built-in cover may snap into the power supply installation port in an interference fit way and seal the power supply installation port.

According to one embodiment of this invention, the built-in cover may be integrally formed at inner sides of the power supply cover.

According to one embodiment of this invention, the power supply cover may slidably snap into the light base from one end of the light base.

According to one embodiment of this invention, the multifunctional light may include a switch and a charging interface. The switch may be electrically connected with the light body to control turn-on and turn-off of the light body, and the light base may have a first through hole and a second through hole. The switch may be embedded into the first through hole in a sealing way and exposed at the first through hole, the charging interface may be electrically connected with the light body, and the charging interface may be exposed at the second through hole.

According to one embodiment of this invention, the multifunctional light may include an interface cover, and the interface cover may seal the second through hole in an interference fit way to cover the charging interface.

According to one embodiment of this invention, the sealing member may be the power supply cover, and perimeters of the sealing members may be fixed at edges of the power supply installation ports in a sealing way through a fastener member.

According to one embodiment of this invention, the multifunctional light may include a magnet, the magnet may be fixed at the light base, and the multifunctional light may be mounted to a target position through the magnet or a strap when in use.

According to one embodiment of this invention, the multifunctional light may include a fixing sheet, the fixing sheet may be disposed at one side of the light base, and the fixing sheet may have a slit.

According to another aspect of this invention, this invention further provides a multifunctional light set including the multifunctional light and a fixing sheet. The multifunctional light includes a light base, a light body, a power supply, a sealing member and a magnet, the light base has a power supply installation port, and the light body is disposed at the light base. The power supply is detachably installed in the light body through the power supply installation port and supplies power to the light body, the sealing member seals the power supply installation port, the magnet is fixed at the light base, and the multifunctional light is mounted to a target position through the magnet or a strap when in use.

Two ends of the fixing sheet have a clamping part, respectively. When the multifunctional light is mounted to the target position, the fixing sheet is configured to install the multifunctional light at the target position and clamps the multifunctional light through the clamping parts to prevent rotation.

According to one embodiment of this invention, the light base of the multifunctional light may have a groove, and the clamping parts at two ends of the fixing sheet may be engaged into two ends of the groove during usage to prevent the multifunctional light from rotating.

According to one embodiment of this invention, the magnet may be fixed inside the groove, and the clamping parts at two ends of the fixing sheet may be engaged into two ends of the groove during usage to prevent the multifunctional light from rotating.

Compared with the prior art, this technical solution has the following advantages:

In the invention, the power supply is detachably installed at the light base by disposing the power supply installation port, and the power supply installation port is sealed through the sealing member, which avoids damage to the circuit board and the power supply inside the light body when the multifunctional light contacts water. In addition, disposing the power supply installation port can facilitate a user to replace the power supply and is also conducive to welding the positive electrode plate of the power supply and the negative electrode plate of the power supply on the light body during the manufacturing process, which is simple and quick.

In one embodiment of the invention, the sealing ring and the built-in cover are provided and the sealing ring fits in the built-in cover in an interference fit way, so as to further increase the sealing and waterproof properties of the multifunctional light. Thus, the multifunctional light has a triple protective sealing and waterproof effect via the sealing ring, the built-in cover and the power supply cover.

In one embodiment of the invention, the fixing sheet is disposed at one side of the light base for winding and fixing an attachment such as a strap, such that the multifunctional light can be detachably installed at the target position through the attachment such as the strap. For example, the multifunctional light can be attached to a sunshade rib of a sunshade, a tent, a swing or other furniture. The installation method is simple and convenient, and difficulty of installation and disassembly operation of the multifunctional light is greatly reduced compared to the conventional method of fixing or bundling by screws.

In one embodiment of the invention, it is convenient for the user to control the turn-on and turn-off of the light body by disposing the switch, and the switch is exposed at the end of the light base through the first through hole. The switch does not occupy the installation space additionally and is not unexpectedly located at the surface of the multifunctional light either. The entire multifunctional light has a beautiful design and smooth lines.

In one embodiment of the invention, the charging interface is provided at one end of the circuit board, so that on the one hand, the rechargeable power supply in the multifunctional light can be charged through the charging interface, or the light body can be directly energized.

In one embodiment of the invention, the magnet is provided to make the multifunctional light be arbitrarily attached to a ferromagnetic target object. Compared with other conventional methods, this method is convenient for installation and disassembly, and the operation is simple and quick.

In one embodiment of the invention, the groove is provided at the light base, and the groove is used not only to fix the magnet, but also to make the clamping parts at both ends of the fixing sheet to be right engaged into two ends of the groove. Thus, when in use, the fixing sheet can be fixed at the target position by a strap, then the multifunctional light is attached to the target position by the magnet, and the clamping parts at two ends of the fixing sheet can be inserted and engaged into the groove. Through the clamping of the fixing sheet, the multifunctional light can be prevented from rotating.

DETAILED DESCRIPTION OF THE INVENTION

Figure 1:
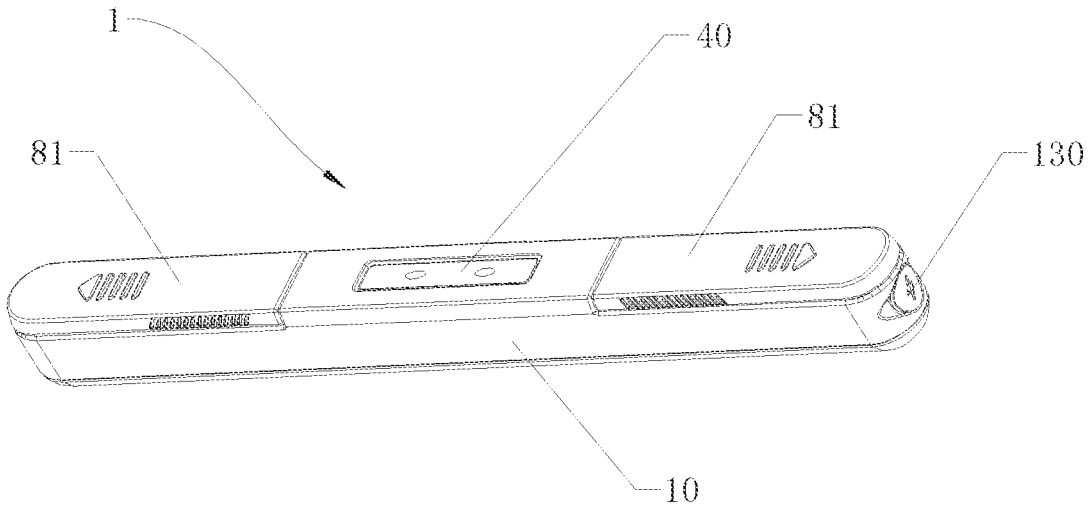
FIG. 1 is a three-dimensional schematic diagram of a multifunctional light according to one embodiment of this invention.

The following description is only used to expose the present invention so that those skilled in the art can implement the present invention. The following described embodiments are only examples, and those skilled in the art can think of other obvious modifications. The basic principle of the present invention defined in the following description can be applied to other embodiments, variants, improvements, equivalents and other solutions without departing from the spirit and scope of the present invention.

As shown in FIG. 1 to FIG. 7, the first embodiment of this invention provides a multifunctional light 1, and more particularly, provides a multifunctional light that can be widely used in, for example, a lighting sunshade, a lighting tent, a swing and other furniture, so as to provide a lighting atmosphere and effect, thereby adding fun to the user's entertainment and leisure activities. The multifunctional light 1 includes a light base 10, a light body 20, power supplies 70 and sealing members 80.

The light base 10 has a long rod shape, and the interior of the light base 10 has an accommodating chamber 101. An opening is provided on one side of the accommodating chamber 101 to accommodate the light body 20 and other components. The light base 10 has power supply installation ports 102. In the first embodiment, the number of the power supply installation ports 102 is two, the two power supply installation ports 102 are located at two ends of the light base 10, respectively, and both the two power supply installation ports 102 communicate with the accommodating chamber 101. However, this invention does not limit the number and position of the power supply installation ports 102. In other embodiments, the number of the power supply installation ports 102 can be other value, such as one, and the power supply installation ports 102 can be disposed at the middle of the light base 10. Moreover, in order to improve safety and waterproof properties, the power supply installation ports 102 do not communicate with the accommodating chamber 101. That is, the chamber for the power supplies is separately disposed in the light base 10.

Figure 4:
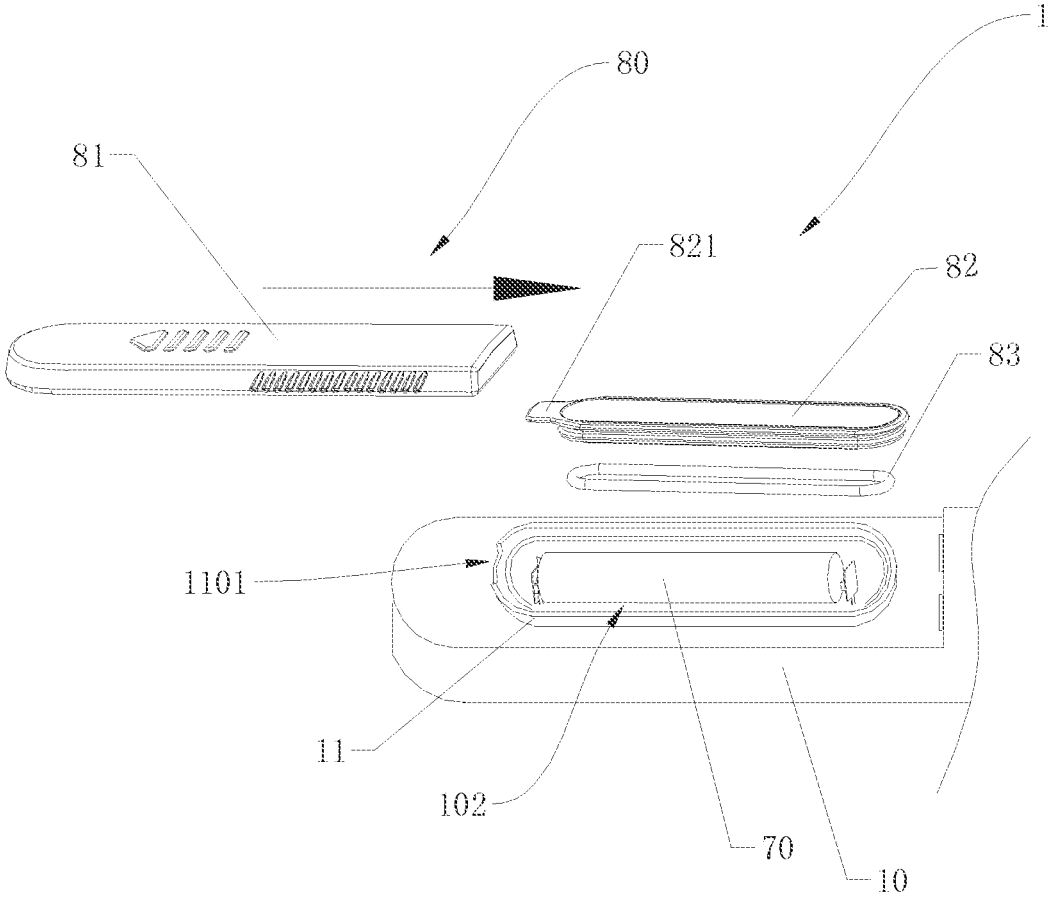
FIG. 4 is a partial enlarged view of the multifunctional light according to one embodiment of this invention, showing installation ways of a power supply, a sealing ring, a built-in cover and a power supply cover.
Figure 5:
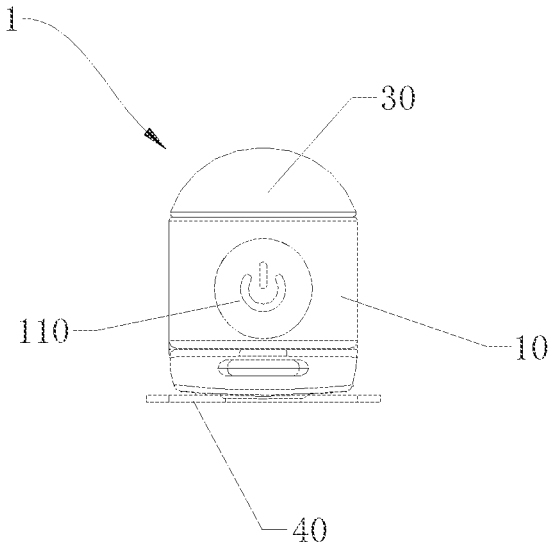
FIG. 5 is a left view of the multifunctional light according to one embodiment of this invention.
Figure 6:
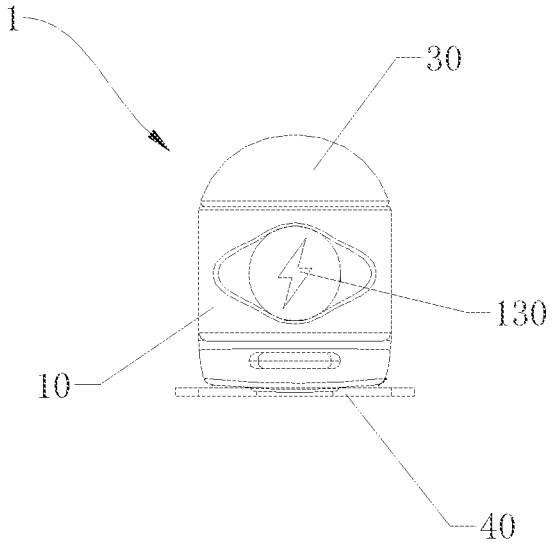
FIG. 6 is a right view of the multifunctional light according to one embodiment of this invention.
Figure 7:
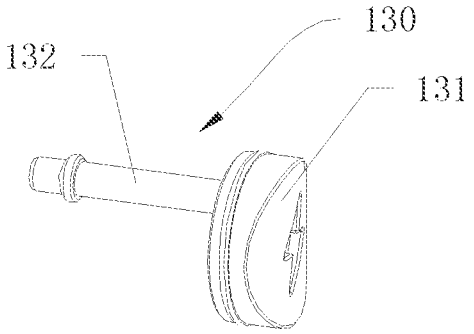
FIG. 7 is a structural schematic diagram of an interface cover of the multifunctional light according to one embodiment of this invention.
Figure 8:
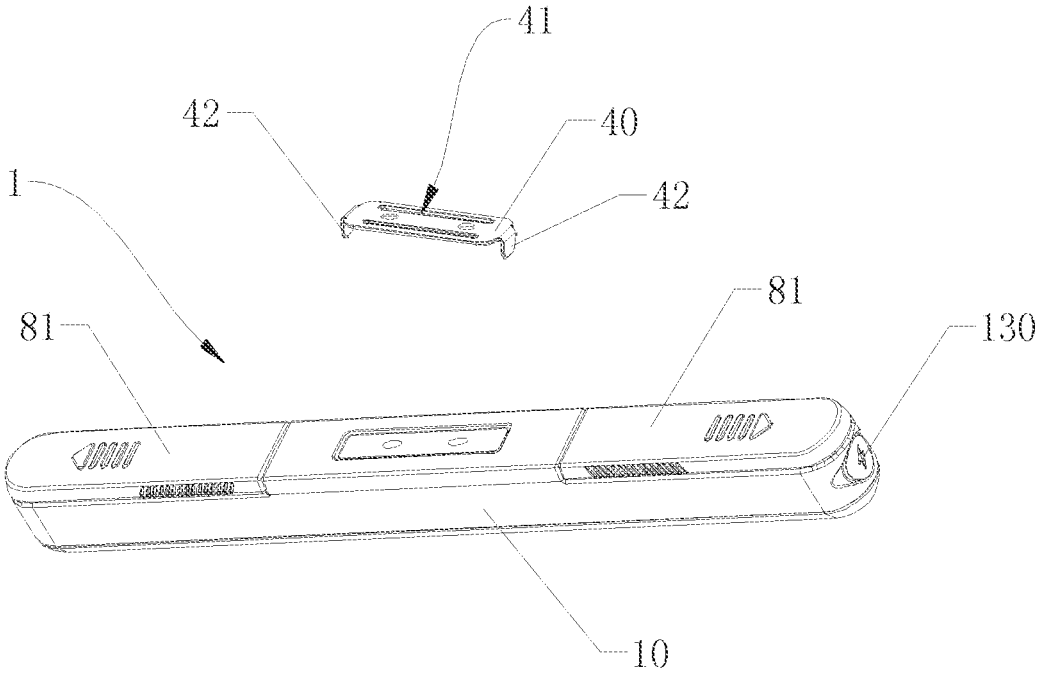
FIG. 8 is a structural schematic diagram of a multifunctional light set provided by this invention.

As shown in FIG. 4, the light base 10 has an annular outer edge protrusion 11 along an edge of each power supply installation port 102. That is, the power supply installation port 102 is formed inside the outer edge protrusion 11. The outer edge protrusion 11 has a notch 1101. The inner wall of the outer edge protrusion 11 has an annular step 11.

Optionally, the light base 10 has a first through hole 103. Optionally, the light base 10 has a second through hole 104. In the first embodiment, the light base 10 has a first through hole 103 and a second through hole 104, and the first through hole 103 and the second through hole 104 are located at two ends of the light base 10, respectively. In other words, the first through hole 103 is located at one end of the light base 10, and the second through hole 104 is located at the other end of the light base 10.

The light body 20 is disposed at the light base 10, and the light body 20 has lights 21 for lighting. In the first embodiment, the light body 20 is a circuit board in a long plate shaped and is disposed inside the accommodating chamber 101. The light base 10 correspondingly has a positioning slot matching with the light body 20, and the light body 20 is locked at the light base 10 through screws. In order to prevent the light body 20 from shifting, two sides of the light base 10 have an inverted hook, respectively, the inverted hooks extend from the inner wall of the light base 10, and the light body 20 is pressed tightly and engaged into the inverted hooks of the light base 10. What's more, another alternative is that the light base 10 also has protrusion platforms at two ends. The protrusion platforms of the light base 10 and holes of the light body 20 match and are fixed to prevent the light body 20 from moving left and right, and the other holes of light body 20 are locked by screws to prevent the light body 20 from moving up and down. However, in other embodiments, the light body 20 can be in other shapes or other forms.

The lights 21 are LED lights, which have good effects of a low working voltage, low power consumption, high lighting efficiency, very short lighting response time, pure light color, novel and firm structure, high impact resistance, high shock resistance, stable and reliable performance, light weight, small volume, etc. As shown in FIG. 4, there are several lights 21, and a plurality of lights 21 is disposed apart at one side of the light body 20. However, this invention is not limited to the type and number of the lights 21. In other embodiments, the lights 21 can be other types; and the number of the lights 21 can be one, i.e., the light 21 is a long strip light. When the light body 20 is electrified, the lights can illuminate.

In this embodiment, the multifunctional light 1 further includes a lampshade 30, and the lampshade 30 is embedded into the light base 10 to seal the accommodating chamber 101. In this way, the light body 20 is hidden between the lampshade 30 and the light base 10. The lampshade 30 not only plays a role of sealing but also plays a role of transmitting light, and the light emitted by the lights 21 of the light body 20 can pass through the lampshade 30. In order to ensure stability and tightness between the lampshade 30 and the light base 10, the lampshade 30 and the light base 10 are welded by ultrasonic welding. However, this invention is not limited to a connection way between the lampshade 30 and the light base 10. In other embodiments, the lampshade 30 and the light base 10 can be connected by epoxy bonding.

The multifunctional light 1 further includes a magnet 50, and the magnet 50 is fixed at the light base 10. When used, the multifunctional light is installed at a target position through the magnet 50 or a strap. In the description of this embodiment, the strap refers not only to a conventional strap, but also includes objects that can be used to install the multifunctional light 1 to a target position other than the magnet 50, such as Velcro, a cord, and an engaging member.

Specifically, the light base 1 has one groove 105, the groove 105 is located between the two power supply installation ports 102, and the magnet 50 has fixing holes 51. The multifunctional light 1 further includes fastener members 60, and the fastener members 60 pass through the fixing holes 51 of the magnet 50 to fix the magnet 50 to the light base 10. Optionally, the fastener members 60 are screws, the number of the fastener members 60 is two, and the number of the fixing holes 51 is also two. The two fastener members 60 respectively pass through the two fixing holes 51 and are screwed into the light base 10. In this way, the magnet 50 is fixed in the groove 105 of the light base 10. By disposing the magnet 50, the user can directly attach the entire multifunctional light 1 to an iron target object, which is convenient to use.

In another embodiment, the functional light 1 adopts a fixing sheet 40 instead of the magnet 50, and the fixing sheet 40 is disposed on one side of the light base 10. The fixing sheet 40 has at least one slit 41. The fixing sheet 40 is directly fixed at the light base 10 through the fastener member 60, or the fixing sheet 40 is directly embedded at the groove 105 of the light base 10, thereby saving the cost of the magnet 50 and being more economical. During usage, the strap is wound around the slit 41 and fixed at the fixing sheet 40, and the multifunctional light 1 is detachably installed at the target position through the strap. For example, the multifunctional light 1 can be installed at a sunshade rib of a sunshade so that the sunshade not only provides shade, but also has a lighting effect. For another example, the multifunctional light 1 is installed at a tent and can be made into an intelligent lighting tent. The multifunctional light 1 can also be installed at a swing or furniture to provide the illumination effect and atmosphere lighting effect. In the first embodiment, the fixing sheet 40 has two slits 41. The two slits 41 are disposed apart to facilitate winding of two straps. However, this invention does not limit the number of the slits 41. In other embodiments, the number of the slit 41 can be other values, such as one. Optionally, the fixing sheet 40 is made of iron or plastic.

Power supplies 70 are detachably installed at the light body 20 through the power supply installation ports 102 and supply power to the light body 20, such that the multifunctional light 1 can be lighted without an external power supply, and the user can replace the power supplies 70 in a simple and convenient way. In the first embodiment, the number of the power supplies 70 is two, the two power supplies 70 are respectively installed at the light body 20 through the two power supply installation ports 102, and both the two power supplies 70 are electrically connected with the light body 20. However, this invention does not limit the number of the power supplies 70. In other embodiments, the number of the power supplies 70 can be other values, such as one or three.

Specifically, in the first embodiment, the light body 20 has two installation holes corresponding to the power supplies 70, and the light body 20 further has two power supply positive plates 22 and two power supply negative plates 23. One of the power supply positive plates 22 and one of the power supply negative plates 23 are taken as one group and welded at the installation hole at one end of the light body 20, so as to install one of the power supplies 70. The other power supply positive plate 22 and the other power supply negative plate 23 are taken as one group and welded at the installation hole at the other end of the light body 20, so as to install the other power supply 70. In the first embodiment, the power supplies 70 are detachable power supplies, for example, 1.2V, 1600 mAh nickel-metal hydride battery. However, this invention is not limited thereto. In other embodiments, the power supply 70 can be any other type of power supply, such as a non-detachable power supply or a rechargeable power supply.

In an actual manufacturing process, in order to facilitate welding, the power supply positive plates 22 and the power supply negative plates 23 can be welded at the installation holes of the light body 20 in advance, and both heads of the power supply positive plates 22 and heads of the power supply negative plates 23 protrude from the installation holes of the light body 20. The power supply positive plates 22 and the power supply negative plates 23 are sequentially welded at the installation holes of the light body 20 by using an electric iron and a solder wire to keep the circuit unblocked, and the excessive protruding heads of the power supply positive plates 22 and the power supply negative plates 23 are removed. Then, the welded light body 20 is integrally assembled into the accommodating chamber 101 of the light base 10. In addition, since welding accuracy of the power supply positive plates 22 and the power supply negative plates 23 is required to be relatively high, if the power supply positive plates 22 and the power supply negative plates 23 are not well soldered, the power supplies 70 will be poor contacted. Therefore, in the actual manufacturing process, after the light body 20 and light base 10 are assembled, the power supply positive plates 22 and power supply negative plates 23 are often not well welded and require rework and repair. In order to avoid inconvenience and trouble of disassembling the light body 20 from the light base 10 after assembly, the light body 20 having the power supply positive plates 22 and the power supply negative plates 23 not welded can be first installed into the accommodating chamber 101 of the light base 10, and then the power supply positive plates 22 and the power supply negative plates 23 are welded to the light body 20 through the power supply installation ports 102.

Figure 2:
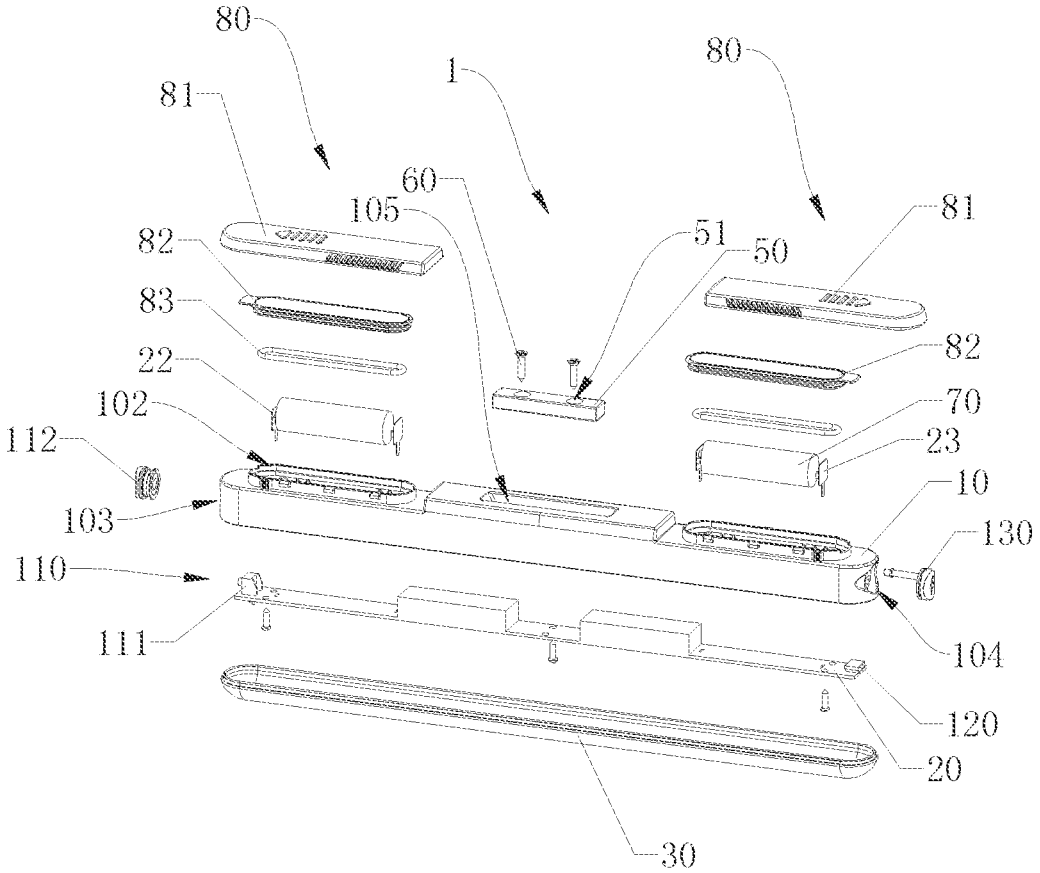
FIG. 2 is a structural exploded view of the multifunctional light according to one embodiment of this invention.
Figure 3:
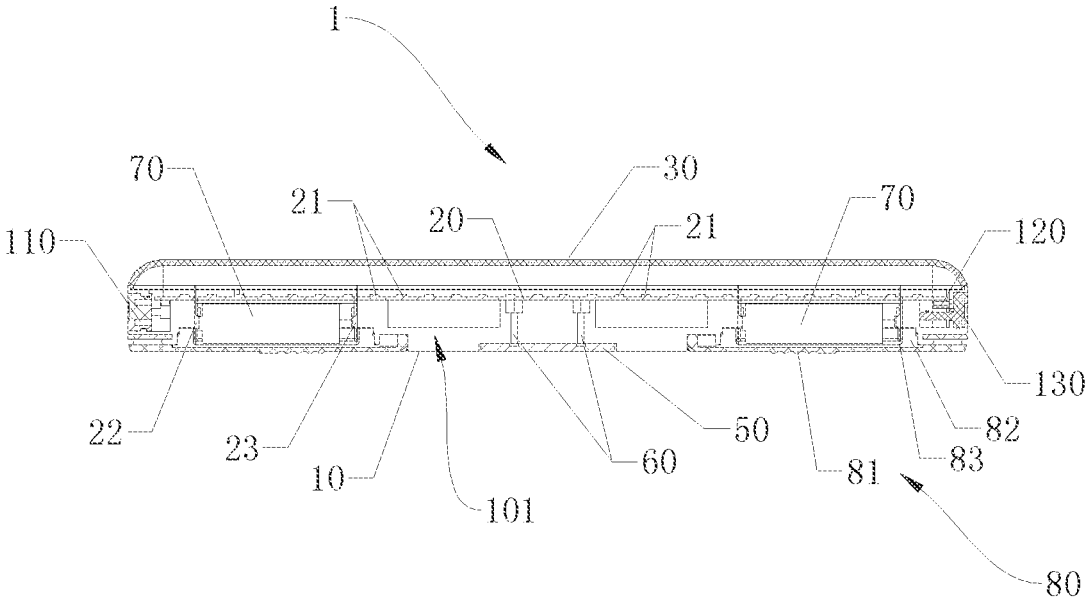
FIG. 3 is a section view of the multifunctional light according to one embodiment of this invention.

The sealing members 80 seal the power supply installation ports 102. As shown in FIG. 2, each of the sealing members 80 includes a power supply cover 81, and the power supply covers 81 seal the power supply installation ports 102. The number of the power supply covers 81 is two, as shown by an arrow in FIG. 4; the power supply cover 81 is slidably engaged into the light base 10 from one end of the light base 10 to cover the power supply installation port 102. However, the number and installation way of the power supply covers 81 are not limited in this invention. For example, in other embodiments, the number of the power supply cover 81 can be one or three, and the power supply cover 81 can also be forcedly buckled into the light base 10 so that the edge of the power supply cover 81 can be engaged with the edge of the light base 10. Optionally, in one embodiment, the power supply cover 81 snaps into the power supply installation port 102 in an interference fit way. For example, the peripheral edge of the power supply cover 81 has a sealing film, that is, the surface of the power supply cover 81 is covered with a layer of sealing film which is made of a soft material, and the power supply cover 81 snaps into the power supply installation port 102 through the sealing film in an interference fit way. In another embodiment, the perimeters of the power supply cover 81 are sealed and fixed at the edge of the power supply installation port 102 through the fastener member such as a screw.

Further, the sealing members 80 further include built-in covers 82, and edges of the built-in covers 82 have extension parts 821. The built-in covers 82 snap into and seal the power supply installation ports 102, the extension parts 821 are engaged at the notch 1101 of the outer edge protrusions 11, the power supply covers 81 are engaged into the light base 10 and cover the built-in covers 82, and the built-in covers 82 are hidden under the power supply covers 81.

In another embodiment, the built-in covers 82 are integrally formed at the inner sides of the power supply covers 81, that is, the power supply covers 81 and the built-in covers 82 are a whole. The built-in covers 82 play a role of the sealing the power supply installation ports 102, for example, the built-in covers 82 are embedded into the power supply installation ports 102 in the interference fit way.

The sealing members 80 further include sealing rings 83, and the sealing ring 83 fit in the inner sides of the built-in covers 82 in the interference fit way. The built-in covers 82 and the sealing rings 83 further reinforce and seal the edges of power supply installation ports 102. The sealing rings 83, built-in covers 82 and power supply covers 81 function as a triple protective seal to prevent the multifunctional light 1 from entering water, which ensures good sealing and waterproof properties. In this embodiment, the numbers of the sealing rings 83 and the built-in covers 82 are both two. The two sealing rings 83 are nested into the two built-in covers 82 in the interference fit way, respectively, and the two built-in covers 82 are engaged and seal the two power supply installation ports 102, respectively. However, the numbers of the sealing rings 83 and the built-in covers 82 are not limited in this invention. In other embodiments, the numbers of the sealing rings 83 and the built-in covers 82 are different according to the number of the power supply installation ports 102, for example, one or three.

In another embodiment, the sealing members 80 only include the power supply covers 81, and the built-in covers 82 and the sealing rings 83 are omitted. That is, the sealing members 80 are the power supply covers. In this way, the sealing members 80 can seal the power supply installation ports by various means. For example, the perimeters of the sealing members 80 seal and are fixed at the edges of the power supply installation ports 102 through the fastening members. For another example, the sealing members 80 are engaged into the power supply installation ports 102 in the interference fit way. Further, for example, the peripheral edges 102 of the sealing members 102 have a sealing film or a plurality of ribs, and the sealing members 80 seal the power supply installation ports 102 by the sealing film or the ribs.

In another embodiment, the sealing members 80 include only the power supply covers 81 and the built-in covers 82, and the sealing rings 83 are omitted. The surfaces of the built-in covers 82 are coated with sealing films. That is, the built-in covers 82 are coated, and the surfaces of the built-in covers 82 are coated with the sealing films which are made of a soft material. The built-in covers 82 are engaged into and seal the power supply installation ports 102 in the interference fit way. In this way, the sealing film is used instead of the sealing ring, and the effect of sealing the power supply installation ports 102 is achieved by the interference fit of the built-in covers 82 and the power supply installation ports 102.

In another embodiment, the sealing members 80 only include the power supply covers 81 and the built-in covers 82, and the sealing rings 83 are omitted. The built-in cover 82 is made of a soft material. The peripheral edges of the built-in covers 82 have a plurality of ribs, for example one to three ribs. The built-in covers 82 are engaged into and seal the power supply installation ports 102 through the ribs at the edges in the interference fit way. Thus, a plurality of ribs on the surface of the built-in covers 82 are used to achieve the sealing effect with the power supply installation ports 102 in the interference fit way.

In another embodiment, the sealing members 80 only include the power supply covers 81 and the sealing rings 83, and the built-in covers 82 are omitted. The sealing rings 83 fit in the inner sides of the power supply covers 81 in the interference fit way. That is, the power supply covers 81 seal the power supply installation ports 102 through the sealing rings 83. Further, the multifunctional light 1 further includes a switch 110, and the switch 110 is electrically connected with the light body 20 to control the turn-on and turn-off of the light body 20. In the first embodiment, the switch 110 is embedding in a sealing way into and exposed at the first through hole 103. For example, the switch 110 is embedded into the first through hole 103 through the interference fit way. The switch 110 includes a switch main body 111 and a button plug 112. The switch main body 111 is a touch switch, and the switch main body 111 is welded at a circuit board 22 of the light body 20. The button plug 112 is made of the soft material such as the rubber. The button plug 112 is embedded in the interference fit way into and exposed at the first through hole 103 to seal the first through hole 103. The button plug 112 itself has a movable telescoping circular stage contacting the switch main body 111, and the user operates the switch main body 111 by pressing the button plug 112. However, this invention is also not limited to the structure of the switch 110 and the cooperation manner with the first through hole 103. For example, in another embodiment, the switch 110 is directly attached to the first through hole 103 of the light base 10, and the switch 110 is fixed at the light base 10 by means of adhesive bonding or ultrasonic welding. For another example, in another embodiment, one side of the switch 110 has a circular slot, and the multifunctional light 1 further includes an engaging block. The engaging block is disposed at the circular slot of the switch 110 and is embedded into the first through hole 103. In this way, the switch 110 is fixed with the light base 10 through the engaging block.

It will be appreciated by those skilled in the art that in another embodiment, the multifunctional light 1 includes a remote controller, and the light body 20 has a remote control electronic module responding to the remote controller. The switch 110 is omitted, and turn-on and turn-off of the light 21 are remotely controlled through the remote controller.

Further, the multifunctional light 1 further includes a charging interface 120, the charging interface 120 is electrically connected with the light body 20, and the charging interface 120 is exposed to the second through hole 104. Optionally, the charging interface 120 is one of a USB interface, a DC interface, and a Type-C interface. However, this invention does not limit the type of the charging interface 120. In other embodiments, the charging interface 120 can be another interface. With the charging interface 120, it is possible to charge the multifunctional light 1 with a rechargeable power supply 70, or to directly energize the light body 20 to light the lights.

The multifunctional light 1 further includes an interface cover 130, and the interface cover 130 is sealed at the second through hole 104 in the interference fit way to cover the charging interface 120 so as to ensure the sealing and waterproof properties of the multifunctional light 1. When the charging interface 120 is used, the user only needs to open the interface cover 130. The interface cover 130 includes a circular cover part 131 and an inserting rod 132, the inserting rod 132 integrally extends at one side of the circular cover part 131, and the circular cover part 131 is embedded into the second through hole 104 in the interference fit way for sealing and water proofing. The inserting rod 132 passes through the second through hole 104 and is located in the light base 10. In the first embodiment, the interface cover 130 is made of rubber. However, this invention is not limited thereto. In other embodiments, the interface cover 130 may be other soft materials.

It is worth mentioning that in the first embodiment, based on the direction shown in FIG. 1, the two power supply installation ports 102 are located at the top surface of the light base 10, and the installation positions of the two power supplies 70 correspond to two power supply installation ports 102, respectively. However, this invention is not limited to the positions of the two power supplies 70 and power supply installation ports 102. For example, in other embodiments, the power supply installation ports 102 are disposed at the left side or the right side of the light base 10, and the two power supplies 70 are electrically connected with the light body 20 from the power supply installation ports 102 at the left or right side of the light base 10. The inner walls of the power supply installation ports 102 are provided with a thread, and the battery covers 100 are screwed connected with the power supply installation ports 102. At this time, the first through hole 103 and the second through hole 104 are both disposed at other positions of the light base 10, for example, the front side surface or the top surface of the light base 10. The switch 110 and the charging interface 120 correspond to the positions of the first through hole 103 and the second through hole 104, respectively.

Figure 9:
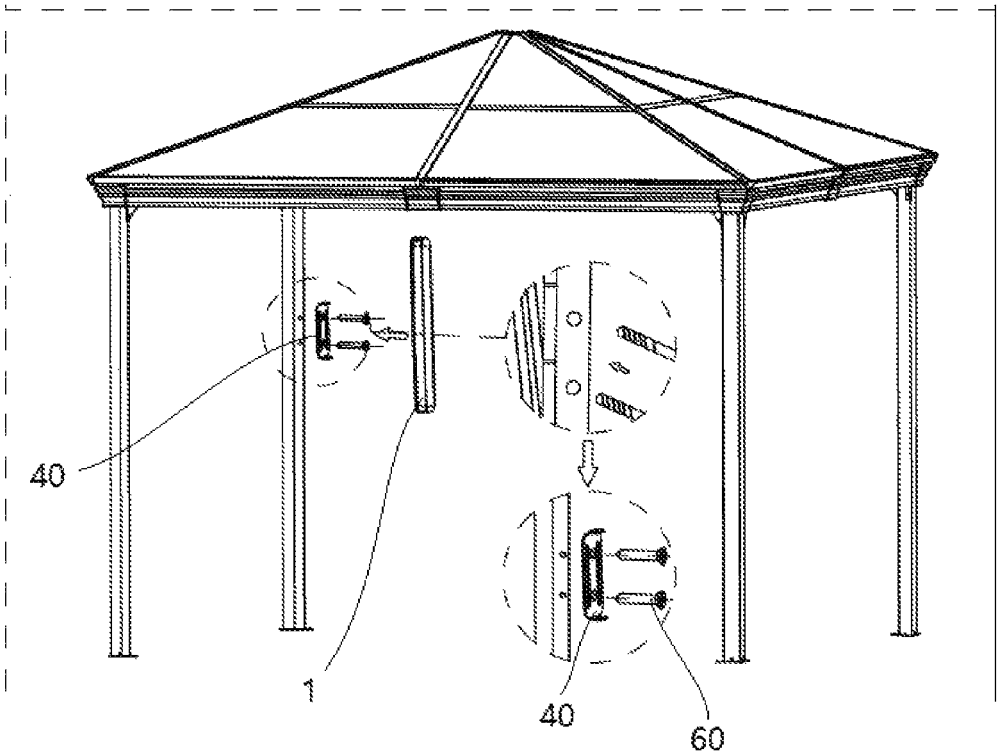
FIG. 9 is an application scene diagram of the multifunctional light and a set thereof of this invention.
Figure 10:
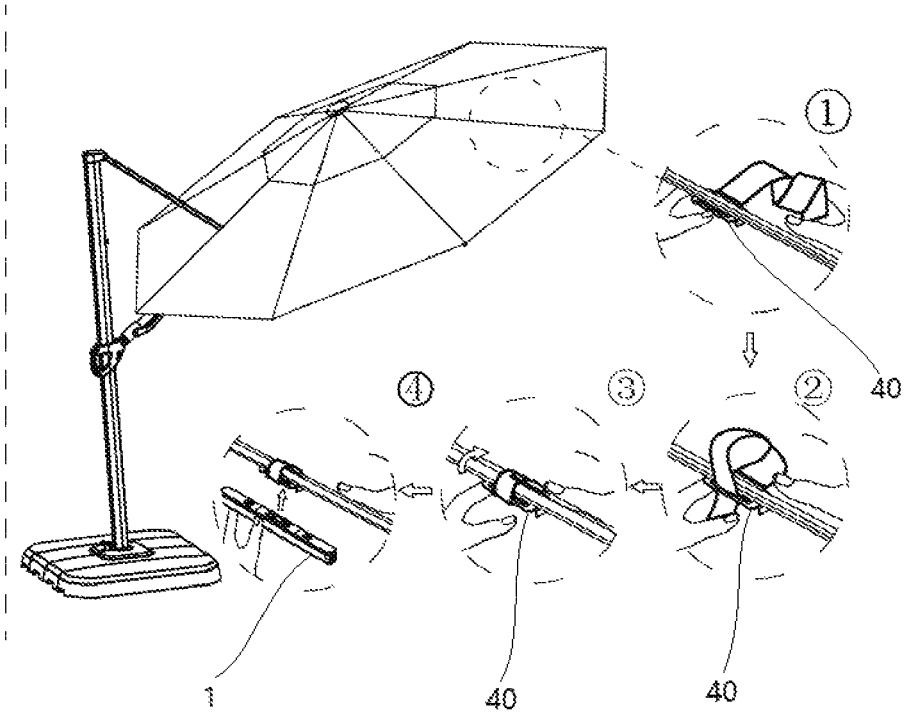
FIG. 10 is another application scene diagram of the multifunctional light and the set thereof of this invention.

According to another aspect of this invention, this invention further provides a multifunctional light and a set thereof which include the above-mentioned multifunctional light 1 and a fixing sheet 40. The fixing sheet 40 has a slit 41, and two ends of the fixing sheet 40 have a clamping part 42, respectively. When the multifunctional light 1 is fixed at the target position, the fixing sheet 40 is installed at the target position and clamps the multifunctional light 1 through clamping parts 42 to prevent rotation. As shown in FIG. 9 and FIG. 10, during usage, the strap is firstly wrapped around the slit 41 of the fixing piece 40 to bind the fixing piece 40 to the target position. For example, the fixing piece 40 can be bound to the rib of the outdoor sunshade or the pillar of an awning, and then the multifunctional lighting fixture 1 is attached to the target position by the magnet 50. At the same time, the clamping parts 42 at two ends of the fixing sheet 40 are engaged into two ends of the groove 105, respectively, to prevent the multifunctional light 1 from rotating.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A multifunctional light comprising:

a strip-shaped light body;

a light base having a plurality of power supply installation ports, wherein the light body is disposed at the light base and all the power supply installation ports are arranged along a length of the lamp body;

a plurality of power supplies detachably installed in the light body through the power supply installation port and supplying power to the light body; and a sealing member sealing all the power supply installation ports, wherein the sealing member comprises a plurality of power supply covers, and the power supply covers snap into the light base from ends of the light base in different directions, respectively.

2. The multifunctional light according to claim 1, wherein the sealing member comprises a plurality of built-in covers, each of the built-in cover snaps into and seals one of the power supply installation ports.

3. The multifunctional light according to claim 2, wherein the sealing member further comprises a sealing ring, and the sealing ring fits in inner sides of the built-in covers in an interference fit way.

4. The multifunctional light according to claim 1, wherein the multifunctional light comprises a switch and a charging interface, the switch is electrically connected with the light body to control turn-on and turn-off of the light body, the light base has a first through hole and a second through hole, the switch is embedded into the first through hole in a sealing way and exposed at the first through hole, the charging interface is electrically connected with the light body, and the charging interface is exposed at the second through hole.

5. The multifunctional light according to claim 4, wherein the multifunctional light comprises an interface cover, and the interface cover seals the second through hole in an interference fit way to cover the charging interface.

6. The multifunctional light according to claim 1, wherein the sealing member acts as a power supply cover, and perimeters of the sealing member are sealingly fixed at edges of each power supply installation port through a fastener member.

7. The multifunctional light according to claim 1, wherein the multifunctional light comprising a magnet, the magnet is fixed at the light base, and the multifunctional light is mounted to a target position by the magnet or a strap when in use.

8. The multifunctional light according to claim 1, wherein the multifunctional light comprises a fixing sheet, the fixing sheet is disposed at one side of the light base, and the fixing sheet has a slit.

9. A multifunctional light set comprising:

a multifunctional light comprising a light base, a light body, a plurality of power supplies, a sealing member, and a magnet, wherein a light base has a plurality of power supply installation ports, the light body is disposed at the light base and all the power supply installation ports are arranged along an arrangement direction of the lamp body; a plurality of power supplies are detachably installed in the light body through the power supply installation ports and supplying power to the light body; a sealing member seals all the power supply installation ports, the sealing member comprises a plurality of power supply covers, and the power supply covers snap into the light base from ends of the light base in different directions, respectively, the magnet is fixed at the light base, and the multifunctional light is mounted to a target position by the magnet or a strap when in use; and a fixing sheet, wherein two ends of the fixing sheet have a clamping part, respectively, when the multifunctional light is mounted to the target position, the fixing sheet is configured to install the multifunctional light at the target position and clamps the multifunctional light through the clamping parts to prevent rotation.

* * * * *